United States Patent [19]

Borneman et al.

[11] Patent Number: 4,533,391

[45] Date of Patent: Aug. 6, 1985

[54] WORK-HARDENABLE SUBSTANTIALLY AUSTENITIC STAINLESS STEEL AND METHOD

[75] Inventors: Paul R. Borneman, Sarver; James B. Hill, Natrona Heights, both of Pa.

[73] Assignee: Allegheny Ludlum Steel Corporation, Pittsburgh, Pa.

[21] Appl. No.: 549,700

[22] Filed: Nov. 7, 1983

[51] Int. Cl.[3] ..... C22C 38/38

[52] U.S. Cl. ..... 75/128 A; 75/128 N; 148/3; 148/12 E

[58] Field of Search ..... 148/38, 12 E, 12 EA, 148/2, 37; 75/128 A, 128 N

[56] References Cited

U.S. PATENT DOCUMENTS

Re. 28,494 7/1975 Rowe ..... 148/12 EA

FOREIGN PATENT DOCUMENTS 0106620 9/1978 Japan ..... 148/38

0152447 9/1982 Japan ..... 148/38

*Primary Examiner*—L. Dewayne Rutledge
*Assistant Examiner*—Deborah Yee
*Attorney, Agent, or Firm*—Patrick J. Viccaro

[57] ABSTRACT

A substantially austenitic stainless steel is provided which is characterized by increased strength resulting from martensite formation upon cold working; the stainless steel consists essentially of, in weight percent, 0.08 max. carbon, 0.25 max. nitrogen, 12 to 15 chromium, 6.5 to 8.5 manganese, about 2 to 3.5 nickel, the sum of manganese and nickel being at least 9.0, and balance iron. The steel is further characterized by having less than 15% ferromagnetic phases in the cast and hot-processed conditions.

A method of producing the steel product including hot working the steel alloy to a thickness which allows cold working by an amount equivalent to up to 25% thickness reduction and cold working without an intermediate anneal is also provided.

19 Claims, No Drawings

WORK-HARDENABLE SUBSTANTIALLY AUSTENITIC STAINLESS STEEL AND METHOD

BACKGROUND OF THE INVENTION

This invention relates to a work-hardenable substantially austenitic stainless steel having a combination of high strength and high uniform tensile elongation. More particularly, the invention relates to a Cr-Mn-Ni substantially austenitic stainless steel having relatively low amounts of Cr and Ni and having desirable properties developed during cold working over a relatively wide range of cold reduction.

In applications such as the manufacture of automobile seat belt anchors, hose clamps, springs, etc., it is desirable to have an austenitic stainless steel which has uniform elongating properties so that it may be readily stretched without necking. In addition, for substantially austenitic stainless steels of this type, it is desirable that they be hardenable by having the capability of being cold rolled, formed, or otherwise cold worked to very high tensile strength levels. To facilitate production, it is also desirable that such stainless steels exhibit a combination of high strength and high uniform tensile elongation after cold rolling or forming over a wide as possible range of amounts of cold work.

In view of the periodic scarcity and high cost of nickel and chromium, it is desirable to provide an alloy of this type wherein the nickel and chromium requirements are lower than the alloys conventionally used. Specifically, AISI Type 304, 301 and 201 stainless steels may be employed in applications of this type and for this purpose require nickel of 3.5% or above and chromium of 16% or above. Type 201 also requires manganese within the range of 5⊥ to 7⊥%.

It is, accordingly, an object of the present invention to provide a work-hardenable substantially austenitic stainless steel that has uniform elongating properties in the cold-worked condition, while requiring nickel and chromium at levels lower than conventional alloys used for the purpose.

It is also an object to provide an alloy which is a suitable substitute for AISI Type 201, 301 and 304 steels in structural applications with a combination of corrosion resistance, high strength and high residual elongation when used in the cold-worked condition.

The alloy should also be capable of being produced by a low-cost process.

SUMMARY OF THE INVENTION

In accordance with the present invention, a work-hardenable substantially austenitic stainless steel is provided consisting essentially of, in weight percent, up to 0.08 max. carbon, up to 0.25 max. nitrogen, 12 to 15 chromium, 6.5 to 8.5 manganese, about 2 to less than 3.5 nickel, the sum of manganese and nickel being at least 9, and the balance iron. The steel is characterized by having prior to cold working less than 15% ferromagnetic phases with the balance of the structure essentially austenite, a controlled amount of which can be mechanically transformed to martensite which after cold working increases the strength, and by having a residual ductility of at least 8% elongation in a 2-inch gauge length after cold work equivalent of up to 25% thickness reduction.

A method of producing a work-hardened substantially austenitic stainless steel product is also provided and comprises melting the alloy, casting the alloy into a shape which can be worked, hot working the alloy to a configuration which allows cold working the alloy by an amount equivalent of up to 25% thickness reduction in producing the final size and shape, and cold working the alloy.

DETAILED DESCRIPTION OF THE PREFERRED EMBODIMENTS

Broadly in the practice of the invention, the substantially austenitic stainless steel consists essentially of, in weight percent, 0.08 max. carbon, 0.25 max. nitrogen, 12 to 15 chromium, 6.5 to 8.5 manganese, 2 to less than 3.5 nickel, with manganese plus nickel being at least 9, and the balance iron.

Upon cold working a steel within the above composition limits of the invention, increased strength will result from both the deformation of the austenitic structure and from mechanical transformation of austenite to martensite. This work hardening is controlled by maintaining the austenite-forming, ferrite-forming and austenite-stabilizing elements, primarily carbon, nitrogen, chromium, manganese and nickel, at levels within the above-recited ranges. By these means, the alloy of the invention is characterized by having less than 15% of ferromagnetic phases ferrite and/or martensite present in both the cast and hot processed conditions, marked strengthening accompanied by martensite transformation during cold deformation and the ability to maintain residual ductility of at least 8% elongation in a 2-inch gauge length after cold work in an amount equivalent to thickness reduction up to 25%. Preferably, the alloy has at least 2% and a range of 2 to 15% of the ferromagnetic phases before cold working. Also, preferably, after cold working the alloy has a high tensile strength at least greater than AISI Type 201 of 140 ksi in the quarter-hard condition, and more preferably, at least 170 ksi. The ductility of the alloy is at least 8%, and preferably at least 10% elongation in a 2-inch gauge length after cold working. Such cold working is equivalent of up to 25% thickness reduction and preferably between 10 to 25% thickness reduction. The alloy is further characterized by overall corrosion resistance properties suitable for structural applications, such as automotive seat belt anchors.

The properties achieved in accordance with the invention are similar to AISI Type 201 which requires chromium of 16 to 18%, manganese of 5.5 to 7.5%, and nickel within the range of 3.5 to 5.5%.

Chromium is present within the range of 12 to 15% in the alloy of the present invention, and preferably ranges from 12 to 13.5%. Chromium is a ferrite-promoting and austenite-stabilizing element and must be controlled within the prescribed ranges to facilitate the desired work-hardening capability as well as contributing to the overall oxidation and general corrosion resistance of the alloy.

Manganese is present within the range of 6.5 to 8.5% in the invention alloy. For continuous casting of the invention alloys, a practical upper limit of manganese may be 8.25%, for manganese increases the fluidity of the alloy in its molten state. Preferably, at least 7.0% manganese is present, and more preferably at least 7.35%. Manganese is a strong austenitizing and weak austenite-stabilizing element which must be controlled within the cited range to facilitate the work-hardening capability.

Nickel is present within the range of about 2 to less than 3.5%. Nickel is a strong austenitizing and austenite-stabilizing element which must be controlled within the prescribed ranges to control the amount and stability of the austenitic structure of the invention alloy which promotes the controlled martensite phase formation necessary for the desired work-hardening and uniform elongating capability. Nickel, preferably, ranges from about 2.5 to 3.5% when Mn content is low in the composition range, but nickel may be as low as 2% when Mn is higher as required by the structural balance of the invention alloys.

The alloys of the present invention are characterized by a structural balance combining the presence of controlled amounts of ferromagnetic phases and controlled austenite stability resulting in increased strength and good residual ductility following cold working. With carbon and nitrogen held within the invention limits, the chromium, manganese and nickel levels must be in the proper relation. When nickel is in the range of the present invention, it has been found that at low chromium of about 13%, lower manganese is required. As chromium levels increase, higher manganese is required. For example, at 12.5% Cr, at least 7% Mn is required, while at 16.0% Cr, at least 8.0 Mn is required when nickel is within the 2–3.5% range. In addition, to contribute to the required structural balance, manganese is present in an amount greater than about 7.35% when nickel is present within the range 2 to 2.5%. Alloys of the instant invention with nickel present within the range of 2.5 to less than 3.5 can achieve the required structural balance with manganese present in amounts as low as 6.5%. It was found that the balance of manganese and nickel should be controlled such that the content of manganese and nickel is at least 9.0% and preferably at least 9.5%.

Nitrogen may range from 0.05% and should not exceed 0.25%, with chromium, manganese and nickel being within the limits of the invention, for the alloy to achieve the required structural balance and to exhibit satisfactory formability. In addition, the alloy, which may be continuously cast as slabs or ingot cast, should contain nitrogen in amounts less than 0.17% to minimize surface defects and may range from 0.07 to less than 0.17% when continuously cast.

In order to better understand the present invention, numerous alloys were prepared in a conventional manner by melting in an induction vacuum furnace, casting into 17-pound (7.7 kg) ingots which were hot rolled to a gauge of about 0.200 inch (5.08 mm) in accordance with the present invention. The hot-rolled material was cold rolled without intermediate anneal to gauges of about 0.180, 0.170, 0.160 or 0.150 inch (4.57, 4.32, 4.06 or 3.81 mm, respectively) to obtain the cold-rolled reductions of 10, 15, 20 or 25%.

Tables I and II contain a series of Heats of stainless steels to demonstrate the composition limits significant to the invention. Table I identifies Heats of AISI Type 201. For the Heats, in addition to the composition, Table II reports yield strength, tensile strength, hardness and elongation of the Heats determined by conventional tests. Table II also represents the percent of ferromagnetic phases (ferrite and/or martensite) present for each Heat therein in both the as-ingot cast and hot-rolled band condition as determined by conventional calibrated magnetic attraction techniques.

TABLE I

| | | Type 201 | | | | | | | | |
|---|---|---|---|---|---|---|---|---|---|---|
| T-201 | Heat No. | C | Mn | Ni | Cr | N | TS ksi | .2 YS ksi | Elong. % in 2" | Hardness |
| Annealed | 873176 | .098 | 6.46 | 3.94 | 16.44 | .093 | 119 | 59 | 53 | 96 $R_b$ |
| | 772533 | .093 | 6.24 | 4.00 | 16.39 | .10 | 122 | 57 | 50.5 | 98 $R_b$ |
| ¼ Hard (9% Red.) | 772533 | .093 | 6.24 | 4.00 | 16.39 | .10 | 140 | 91 | 36 | 31 $R_c$ |
| | 772533 | .093 | 6.24 | 4.00 | 16.39 | .10 | 135 | 88 | 40 | 29 $R_c$ |
| Reannealed | 772533 | .093 | 6.24 | 4.00 | 16.39 | .10 | 117 | 47 | 55.75 | 92 $R_b$ |

Table I demonstrates the strength and elongation properties of Type 201 alloy. In the ¼-hard (9% reduction) condition, the 201 alloy has a tensile strength (TS) of 140 ksi (965 MPa), a 0.2 yield strength (YS) of 91 ksi (627 MPa), and an elongation in 2-inch gauge length of 36%.

TABLE II

| Heat No. | C | Mn | Ni | Cr | N | Mn + Ni | | TS ksi | .2 YS ksi | Elong. % in 1" | Converted Elong. % in 2" | Hardness | % Ferromagnetic Phases (Ferrite + Martensite) Ingot (As-Cast) | Hot-Rolled Band (Air Cooled) |
|---|---|---|---|---|---|---|---|---|---|---|---|---|---|---|
| | | | | | | | 12.5 Cr (Increasing Ni) | | | | | | | |
| RV 9094A | .041 | 6.98 | 1.56 | 12.30 | .10 | 8.45 | 10% Red. | 212 | 206 | 10.5 | 4.3 | 46 $R_c$ | >50 | >50 |
| | | | | | | | 15% Red. | 236 | 232 | 9.5 | 3.3 | 45 | | |
| | | | | | | | 20% Red. | 240 | 236 | 6 | 0 | 46 | | |
| | | | | | | | 25% Red. | 247 | 242 | 6 | 0 | 46 | | |
| RV 9094B | .042 | 6.98 | 1.78 | 12.31 | .10 | 8.76 | 10% Red. | 212 | 205 | 14.25 | 7.8 | 46 $R_c$ | 35–47 | >50 |
| | | | | | | | 15% Red. | 234 | 231 | 12 | 5.7 | 45.5 | | |
| | | | | | | | 20% Red. | 241 | 238 | 9.75 | 3.6 | 46 | | |
| | | | | | | | 25% Red. | 250 | 247 | 9.5 | 3.3 | 46 | | |
| RV 9094C | .041 | 6.97 | 1.97 | 12.26 | .098 | 8.94 | 10% Red. | 202 | 190 | 17.25 | 10.6 | 46 $R_c$ | 34–47 | 27.4 |
| | | | | | | | 15% Red. | 230 | 227 | 12.25 | 5.9 | 45.5 | | |
| | | | | | | | 20% Red. | 239 | 237 | 10 | 3.8 | 45.5 | | |
| | | | | | | | 25% Red. | 249 | 246 | 7.5 | 1.5 | 46 | | |
| | | | | | | | 12 Cr | | | | | | | |

TABLE II-continued

| Heat No. | C | Mn | Ni | Cr | N | Mn + Ni | | TS ksi | .2 YS ksi | Elong. % in 1" | Converted Elong. % in 2" | Hardness | % Ferromagnetic Phases (Ferrite + Martensite) Ingot (As-Cast) | Hot-Rolled Band (Air Cooled) |
|---|---|---|---|---|---|---|---|---|---|---|---|---|---|---|
| RV 9095A | .042 | 7.11 | 1.78 | 11.80 | .098 | 8.89 | 10% Red. | 211 | 203 | 5 | 0 | 43.5 $R_c$ | 35->50 | |
| | | | | | | | | | | | | | >50 | |
| | | | | | | | 15% Red. | 236 | 232 | 9 | 2.9 | 45 | | |
| | | | | | | | 20% Red. | 246 | 241 | 8.5 | 2.4 | 45 | | |
| | | | | | | | 25% Red. | 250 | 245 | 6.75 | 0.8 | 46 | | |
| | | | | | | | 12.5 Cr | | | | | | | |
| RV 9095B | .041 | 7.07 | 1.78 | 12.35 | .097 | 8.85 | 10% Red. | 213 | 209 | 10.75 | 4.5 | 45.5 $R_c$ | 35–44 | 46.1 |
| | | | | | | | 15% Red. | 239 | 236 | 9 | 2.8 | 45.5 | | |
| | | | | | | | 20% Red. | 244 | 241 | 7 | 1 | 45.5 | | |
| | | | | | | | 25% Red. | 248 | 244 | 7 | 1 | 46 | | |
| | | | | | | | 13 Cr | | | | | | | |
| RV 9095C | .040 | 6.98 | 1.77 | 12.80 | .096 | 8.75 | 10% Red. | 214 | 206 | 12.75 | 6.2 | 43 $R_c$ | 35–39 | 49.0 |
| | | | | | | | 15% Red. | 230 | 227 | 11.75 | 5.4 | 45.5 | | |
| | | | | | | | 20% Red. | 243 | 239 | 10.25 | 4 | 45.5 | | |
| | | | | | | | 25% Red. | 249 | 247 | 10 | 3.8 | 45.5 | | |
| | | | | | | | 13.5 Cr | | | | | | | |
| RV 9107A | .039 | 7.11 | 2.13 | 13.43 | .095 | 9.24 | 10% Red. | 191 | 96 | 21.5 | 14.7 | 38 $R_c$ | 34–35 | 6.25–7.15 |
| | | | | | | | 15% Red. | 203 | 140 | 18.75 | 12 | 42.5 | | |
| | | | | | | | 20% Red. | 214 | 192 | 15.25 | 8.8 | 44.5 | | |
| | | | | | | | 25% Red. | 237 | 228 | 7.5 | 1.5 | 45.5 | | |
| RV 9107B | .038 | 7.28 | 2.13 | 13.46 | .097 | 9.41 | 10% Red. | 189 | 88 | 22 | 15.1 | 38 $R_c$ | 13–14 | 5.0 |
| | | | | | | | 15% Red. | 205 | 143 | 21 | 14.2 | 42.5 | | |
| | | | | | | | 20% Red. | 210 | 173 | 16.25 | 9.7 | 43.5 | | |
| | | | | | | | 25% Red. | 225 | 219 | 13 | 6.6 | 45.5 | | |
| RV 9107C | .038 | 7.42 | 2.14 | 13.47 | .097 | 9.56 | 10% Red. | 184 | 113 | 27.25 | 20 | 37 $R_c$ | 4–5 | 4.85–1.2 |
| | | | | | | | 15% Red. | 199 | 130 | 21.5 | 14.7 | 40.5 | | |
| | | | | | | | 20% Red. | 211 | 176 | 18 | 11.3 | 43.5 | | |
| | | | | | | | 25% Red. | 218 | 202 | 16.25 | 9.7 | 45.5 | | |
| | | | | | | | 12 Cr | | | | | | | |
| RV 9110 | .044 | 7.86 | 2.24 | 12.16 | .10 | 10.10 | 10% Red. | 174 | 70 | 30.25 | 23.4 | 29 $R_c$ | 12 | 3.5 |
| | | | | | | | 15% Red. | 195 | 104 | 20.25 | 13.4 | 41 | | |
| | | | | | | | 20% Red. | 209 | 150 | 17.25 | 10.6 | 43.5 | | |
| | | | | | | | 25% Red. | 218 | 186 | 16 | 9.5 | 45.5 | | |
| RV 9111 | .040 | 8.11 | 2.25 | 12.23 | .11 | 10.36 | 10% Red. | 180 | 69 | 25.25 | 18.8 | 33 $R_c$ | 9.8 | 4.35–6.35 |
| | | | | | | | 15% Red. | 192 | 109 | 20.25 | 14 | 40 | | |
| | | | | | | | 20% Red. | 203 | 149 | 18.25 | 11.6 | 43 | | |
| | | | | | | | 25% Red. | 213 | 187 | 15.5 | 9 | 45 | | |
| RV 9112 | .046 | 8.33 | 2.26 | 11.95 | .12 | 10.59 | 10% Red. | 185 | 77 | 29.5 | 22.7 | 35 | 4.2 | 6.7 |
| | | | | | | | 15% Red. | 191 | 103 | 23 | 16.6 | 39 | | |
| | | | | | | | 20% Red. | 204 | 122 | 19.5 | 12.8 | 42 | | |
| | | | | | | | 25% Red. | 215 | 184 | 14.75 | 8.3 | 45.5 | | |

As may be seen from Table II, with about 0.04% carbon and 0.10% nitrogen, at least 2% nickel is required for a large amount of thermally-stable austenite after casting and hot rolling. Specifically, Heats RV 9094 and RV 9095 have less than 2% nickel, and as may be seen from Table II, they exhibited large amounts of ferrite and/or martensite in both the ingot-cast and hot-rolled band conditions. As may be seen from the nominally 13.5% chromium alloys in Heats RV 9107A, B and C, even if nickel is present in an amount of about 2.13%, the thermal and mechanical stability of the austenite is increased as manganese is increased from 7.11 to 7.42% with nitrogen about 0.10%. Generally, in accordance with the invention, as the nickel content of the alloy is decreased within the range of less than 3.5% to 2%, manganese should be increased, so that the content of nickel plus manganese is greater than 9.0% and preferably greater than 9.5%, preferably in combination with increased nitrogen.

Heats RV 9094A, B and C represent nominally 12.5% Cr-7.0% Mn alloys with increasing Ni contents of 1.56 up to 1.97%. The increasing nickel increases the alloy stability by decreasing the percent of ferromagnetic phases in both the ingot-cast and hot-rolled conditions. The increasing nickel also shows a general tendency to increase the percent elongation with no detrimental effect on tensile strength, yield strength, or hardness. None of these Heats have less than 15% ferromagnetic phases, although all meet the strength requirements of the present invention. Only Heat RV 9094C in the 10% cold-reduction condition has at least 8% elongation (2-inch gauge) of the present invention at 1.97% Ni and 8.94% sum of Mn and Ni.

Heats RV 9095A, B and C represent Cr-Mn-Ni alloys having nominally 7% Mn and 1.75% Ni for Cr contents varying from 12 to 13%. These Heats show that increasing Cr content improves the elongation properties somewhat, however, the Heats have too great a percentage of ferromagnetic phases (i.e., >15%). Although the strengths were high, the Heats are not alloys of the invention and do not exhibit the required elongation of 8% in the cold-worked condition. Furthermore, the sum of Mn and Ni for each Heat is less than 9%.

The Heats RV 9094A, B and C and RV 9095A, B and C also represent that at about 12.5% Cr and about 2.0% Ni, at least about 7% Mn is necessary Heats RV 9107A, B and C represent nominally 13.5% Cr-2.25% Ni with increasing Mn content of 7.11 to 7.42%. All of the Heats except RV 9107A have less than 15% ferromagnetic phases and all have high strength much greater than the 140 ksi tensile strength of AISI Type 201. All Heats have a total Mn and Ni content of at least 9.0%. Heats RV 9107A and B show that the alloy has at least 8% elongation (2-inch gauge) over the cold reduction equivalent of less than 20%, specifically 10 to 20%. Heats RV 9107B and C show that the alloy has improved elongation for up to 25% reduction when the sum of Mn and Ni is about 9.5% or more and the Mn content is about 7.35%. All of Heat RV 9107C as produced by the method of the present invention satisfies the alloy of the present invention.

Heats RV 9110, 9111 and 9112 are alloys of the present invention. Even at low Cr of nominally 12%, the alloy has high strength of at least 170 ksi tensile strength, 2-inch gauge elongation greater than 8% after cold-work equivalent to 10 to 25% thickness reduction, and less than 15% ferromagnetic phases in the hot-processed and ingot-cast conditions.

The method of the present invention comprises conventional steps of melting and casting the alloy. By "casting" it is meant to broadly include all manners of casting including ingot casting and continuous casting. The cast alloy is then hot processed, including heat treatments, and hot worked to within 25% of the final gauge. Thereafter, in accordance with this invention, the alloy is cold worked an equivalent up to 25% thickness reduction to work harden the steel without intermediate annealing during the cold working.

Articles produced from the alloy composition and by the methods of the present invention can be formed with the required degree of cold working or a portion thereof introduced by stretching and deep drawing to produce an article having at least 8% elongation (2-inch gauge), and will have moderate corrosion resistance.

As was the object of the present invention, an alloy is provided which is leaner in Cr and Ni and which is a work-hardenable substantially austenitic stainless steel having high strength, good ductility (as characterized by elongation), adequate hardness, and moderate corrosion resistance. The process for producing the alloy is a lower-cost process which eliminates intermediate annealing steps between cold-rolling passes. Furthermore, the process includes cold working over a broad range of reductions which permits leeway in achieving the desired combination of properties and finished product sizes.

Although several embodiments of the present invention have been shown and described, it will be apparent to those skilled in the art that modifications may be made therein without departing from the scope of the invention.

What is claimed is:

1. A work-hardenable substantially austenitic stainless steel consisting essentially of, in weight percent, up to 0.08 max. carbon, up to 0.25 max. nitrogen, 12–15 chromium, 6.5 to 8.5 manganese, about 2 to less than 3.5 nickel, the sum of maganese and nickel being at least 9, and the balance iron and impurities, said steel being characterized by less than 15% ferromagnetic phases of ferrite and/or martensite in the cast and hot-processed conditions and increased strength resulting from martensite formation upon cold working the alloy an equivalent of up to 25% thickness reduction to final product without annealing.

2. The steel as set forth in claim 1 wherein manganese is at least 7.35 when nickel is present in the range of about 2 to 2.5.

3. The steel as set forth in claim 1 wherein nickel is at least 2.5 when manganese is present as low as 6.5.

4. The steel as set forth in claim 1 wherein nitrogen is less than 0.17.

5. The steel as set forth in claim 1 wherein nitrogen is at least 0.05%.

6. The steel as set forth in claim 1 wherein the sum of manganese and nickel is at least 9.5.

7. The steel as set forth in claim 1 characterized by having 2 to 15% ferromagnetic phases of ferrite and/or martensite in both the cast and hot-processed conditions.

8. The steel as set forth in claim 1 characterized by a ductility of at least 8% elongation in a 2-inch gauge length after cold-work equivalent of up to 25% thickness reduction.

9. The steel as set forth in claim 8 wherein the cold work is equivalent of between 10 to 25% thickness reduction.

10. The steel as set forth in claim 1 having 12 to 13.5 chromium.

11. The steel as set forth in claim 1 characterized by a tensile strength of at least 140 ksi.

12. A work-hardenable substantially austenitic stainless steel consisting essentially of, in weight percent, up to 0.08 max. carbon, 0.07 to 0.17 nitrogen, 12 to 15 chromium, 7.35 to 8.5 manganese, about 2 to 2.5 nickel, the sum of manganese and nickel being 9.5 or more, the balance iron and impurities, said steel being characterized by less than 15% ferrite and martensite phases in the cast and hot-processed conditions and by a tensile strength of at least 140 ksi, ductility of at least 8% in a 2-inch gauge length after cold work equivalent of up to 25% thickness reduction to final product without annealing.

13. The steel as set forth in claim 12 having 12 to 13.5 chromium.

14. The steel as set forth in claim 12 characterized by having 2 to 15% ferrite and martensite phases in the cast and hot-processed conditions.

15. A method of producing a work-hardened austenitic stainless steel product, the method comprising melting an alloy consisting essentially of, in weight percent, up to 0.08 max. carbon, up to 0.25 max. nitrogen, 12 to 15 chromium, 6.5 to 8.5 manganese, about 2 to less than 3.5 nickel, the sum of manganese and nickel being 9 or more, and the balance iron and impurities;

casting the alloy into a shape which can be worked;

hot working the alloy, said alloy having less than 15% ferromagnetic phases in the as-cast and hot-processed conditions; and then cold working the alloy equivalent of up to 25% thickness reduction to final product without annealing to achieve desired properties.

16. The method as set forth in claim 15 wherein cold working the alloy equivalent of 10 up to 25% thickness reduction.

17. The method as set forth in claim 15 wherein cold working is equivalent of 10 up to 20% thickness reduction.

18. The method as set forth in claim 15 wherein the alloy has 0.07 to 0.17 nitrogen, 7.35 to 8.5 manganese, 2 to 2.5 nickel, and the sum of manganese and nickel being 9.5 or more.

19. The method as set forth in claim 15 wherein the hot working includes working the alloy to a thickness which allows cold deformation by an amount equivalent of up to 25% thickness reduction.

* * * * *